US006082465A

United States Patent [19]

Retzloff

[11] Patent Number: 6,082,465

[45] Date of Patent: Jul. 4, 2000

[54] THRUST REVERSER SPRINKLER HEAD

[75] Inventor: James G. Retzloff, Lansing, Mich.

[73] Assignee: The Viking Corporation, Hastings, Mich.

[21] Appl. No.: 09/164,702

[22] Filed: Oct. 1, 1998

[51] Int. Cl.[7] ..... A62C 2/00

[52] U.S. Cl. ..... 169/47; 169/37; 239/498; 239/500; 239/512; 239/514

[58] Field of Search ..... 169/5, 16, 37–39, 169/42, 43, 46, 47, 54, 56, 57–59, DIG. 3; 239/1, 11, DIG. 7, 498, 500, 502, 504, 512, 514, 524, 505, 453, 454, 222.11, 223

[56] References Cited

U.S. PATENT DOCUMENTS

| | | | |
|---|---|---|---|
| 712,693 | 11/1902 | Linn . | |
| 1,492,750 | 5/1924 | Rogers et al. | 239/524 |
| 1,715,205 | 5/1929 | Mantsion . | |
| 2,025,063 | 12/1935 | Loepsinger | 169/37 |
| 2,862,565 | 12/1958 | Dukes | 169/38 |
| 3,682,251 | 8/1972 | Livingston | 169/37 |
| 3,958,760 | 5/1976 | Rosenberg | 239/453 |
| 4,356,974 | 11/1982 | Rosenberg et al. | 239/382 |
| 4,580,729 | 4/1986 | Pounder | 239/524 |
| 4,711,399 | 12/1987 | Rosenberg | 239/498 |
| 4,830,118 | 5/1989 | Capasso | 169/90 |
| 4,993,496 | 2/1991 | Riedle et al. | 169/38 |
| 5,036,923 | 8/1991 | Shea, Sr. | 169/37 |
| 5,609,211 | 3/1997 | Meyer et al. | 169/37 |

FOREIGN PATENT DOCUMENTS

| | | |
|---|---|---|
| 304958 | 3/1972 | U.S.S.R. . |
| 12725 | 9/1888 | United Kingdom . |

OTHER PUBLICATIONS

Sarpkaya, T. and Hiriart, G., *Finite Elements in Fluids*, Chapter 14, "Finite Element Analysis of Jet Impingement on Axisymmetric Curved Deflectors," (1975).

*Primary Examiner*—Andres Kashnikow
*Assistant Examiner*—Lisa Ann Douglas
*Attorney, Agent, or Firm*—Van Dyke, Gardner, Linn & Burkhart, LLP

[57] ABSTRACT

A fire extinguishing sprinkler nozzle includes a body defining a central channel or bore through which water flows during a fire. The sprinkler nozzle includes a fluid flow thrust reverser disposed over the orifice of the central channel such that water exiting out of the channel impinges the thrust reverser. The direction of water flow is reversed by the thrust reverser. After exiting the thrust reverser, the water impinges the impact surface of deflector disposed around the periphery of the sprinkler body. An upright sprinkler nozzle is thereby provided in which the water has a downward momentum prior to its impinging the impact surface of the deflector that is comparable to a pendent sprinkler head. The sprinkler nozzle is activated by conventional fire detecting or heat sensitive structures.

28 Claims, 6 Drawing Sheets

THRUST REVERSER SPRINKLER HEAD

BACKGROUND OF THE INVENTION

This invention relates generally to fire extinguishing sprinkler heads, and more particularly to upright sprinkler heads disposed above a water or other fire extinguishing fluid supply pipe.

Fire extinguishing sprinkler heads come in three general types: upright pendant, and sidewall. Of particular interest to the present application are the upright and pendant types. Pendant sprinkler heads are sprinkler heads that hang below a fire extinguishing fluid supply pipe, such as a water pipe. Examples of two different positionings of prior art pendant sprinkler heads are shown in FIG. 1. As one example, a sprinkler head 10 depends downwardly directly from a water supply pipe 12. As another example, sprinkler head 10A also depends downwardly from water supply pipe 12, but is attached to a downward extension pipe 14. Both sprinkler heads are of the pendant type. When a fire is detected, the water flows through sprinkler head 10 and downwardly over an area to be sprinkled. As the water exits from the sprinkler head, it is typically dispersed by a deflector 16 that distributes the relatively compact and concentrated flow of water coming from the supply pipes.

An upright sprinkler differs from a pendant sprinkler in that it is disposed above the water supply pipe. When an upright sprinkler is activated, the water flows upward through the sprinkler and exits a central orifice in the sprinkler head while traveling upward. Gravity, in partial combination with a deflector positioned above the central orifice, causes the water to fall back downward over the area to be sprinkled. In many prior upright sprinklers the deflector provides a somewhat concave undersurface relative to the sprinkler outlet orifice. In the past, such upright sprinkler deflectors have utilized smoothly curved undersurfaces and have also utilized planar undersurfaces with outer prongs disposed at an obtuse angle in efforts to obtain a downwardly directed spray of fluid.

Pendant sprinkler heads suffer from the disadvantage that rust or debris may tend to accumulate in an area 18 (FIG. 1) just above the top of the sprinkler head. Because these areas 18 are lower than the water supply pipe, any particles or debris in the water supply pipe will tend to eventually settle in these areas. If enough debris accumulates, it may interfere with the proper functioning of the sprinkler head, which, of course, is undesirable. Pendant sprinkler heads also suffer from the disadvantage that they cannot be used in cold areas where the temperature dips below the freezing level of the fire extinguishing fluid. After a single activation of the sprinkler system is such a cold area, the fluid would collect above the inactivated pendant sprinkler heads in the supply pipe and eventually freeze. The frozen pipes would prevent proper functioning of the sprinkler system.

Upright sprinkler heads do not suffer from the potential problem of debris accumulation because they are positioned above the water supply pipe. Whatever debris that may be present in the water supply pipe will settle on the bottom of the supply pipe where it will not interfere with the functioning of the sprinkler head. Moreover, upright sprinkler heads provide a generally faster response time than do pendant sprinkler heads because they can be positioned closer to the ceiling, due to the lack of an intervening supply pipe. Because the heat of a fire will rise to the ceiling and accumulate there, the closer the sprinkler head is to the ceiling, the faster it will be activated by the heat. Upright sprinkler heads, however, suffer from the disadvantage that the momentum of the water exiting the central orifice of the sprinkler head is vertically upward. The design of the sprinkler deflector and gravity must redirect the water flow toward the area to be protected since the fire will normally be below the sprinkler head. The momentum of the water, however, will therefore be in the "wrong" direction. The result of the upward momentum of the water in the past has been to produce a downwardly directed spray of water in the general area immediately below the upright sprinkler that lacks downward momentum except for that generated by gravity. Not only is this an inefficient use of the momentum of the water exiting the supply pipe, but it can lead to a diminished ability to extinguish a fire. Specifically, if the fire is large enough, the downward momentum of the water due to gravity may be insufficient to carry the water to the desired locations beneath the sprinkler. Instead, if the fire is large enough, the upward movement of the heat and air above the fire may be large enough to overcome the water's momentum and deflect the water, thereby preventing it from reaching certain areas of the fire. Such a result, of course, is undesirable.

The desirability of a sprinkler head that overcomes these and other disadvantages can therefore be seen.

SUMMARY OF THE INVENTION

Accordingly, the present invention provides a sprinkler head that overcomes the above-mentioned disadvantages of both upright and pendant sprinkler heads. A sprinkler head according to one aspect of the present invention includes a sprinkler body that defines an outlet from which a fire extinguishing fluid flows during a fire. A deflector is disposed around the periphery of the sprinkler body. The sprinkler head further includes a fluid flow thrust reverser disposed adjacent the outlet from the sprinkler and in the flow path of the exiting fire extinguishing fluid. The thrust reverser reverses the flow of the fluid such that the fluid impinges the deflector and is dispersed generally downwardly over the area to be sprinkled.

According to another aspect of the present invention, a fire extinguishing system is provided for protecting a room against fires. The system includes a fluid supply pipe having a top facing the ceiling of the room. At least one upright sprinkler is attached to the top of the fluid supply pipe and in fluid communication with the supply pipe. A deflector is mounted on the sprinkler head and includes a top surface facing the ceiling. The sprinkler head is adapted to direct fluid from the fluid supply pipe against the top surface of the deflector when a fire is detected.

According to another aspect of the present invention, a method for controlling the flow of fluid through a fire extinguishing nozzle consists of providing a pressurized source of water, a sensor for detecting a fire, and a nozzle body having an internal fluid channel. During a fire, water is pumped through the internal channel and out an outlet defined at an end of the nozzle. When the water exits from the outlet, it is flowing in a first direction. After exiting the outlet, the flow of water is reversed to a second, opposite direction, and then dispersed over an area in which the fire is detected.

The sprinkler nozzle of the present invention provides the benefits of a pendant sprinkler nozzle without the prior associated disadvantages. Because the present nozzle is an upright type sprinkler, it does not suffer the potential problem of debris accumulation at its connection to the fluid supply pipe. Yet, the present invention provides a downward flow of fluid that impinges the top of a deflector with all, or nearly all, the momentum of a pendant sprinkler head. These and other benefits, results, and objects of the present invention will be apparent to one skilled in the art, in light of the following specification when read in conjunction with the accompanying drawings.

DESCRIPTION OF THE PREFERRED EMBODIMENTS

Figure 1:
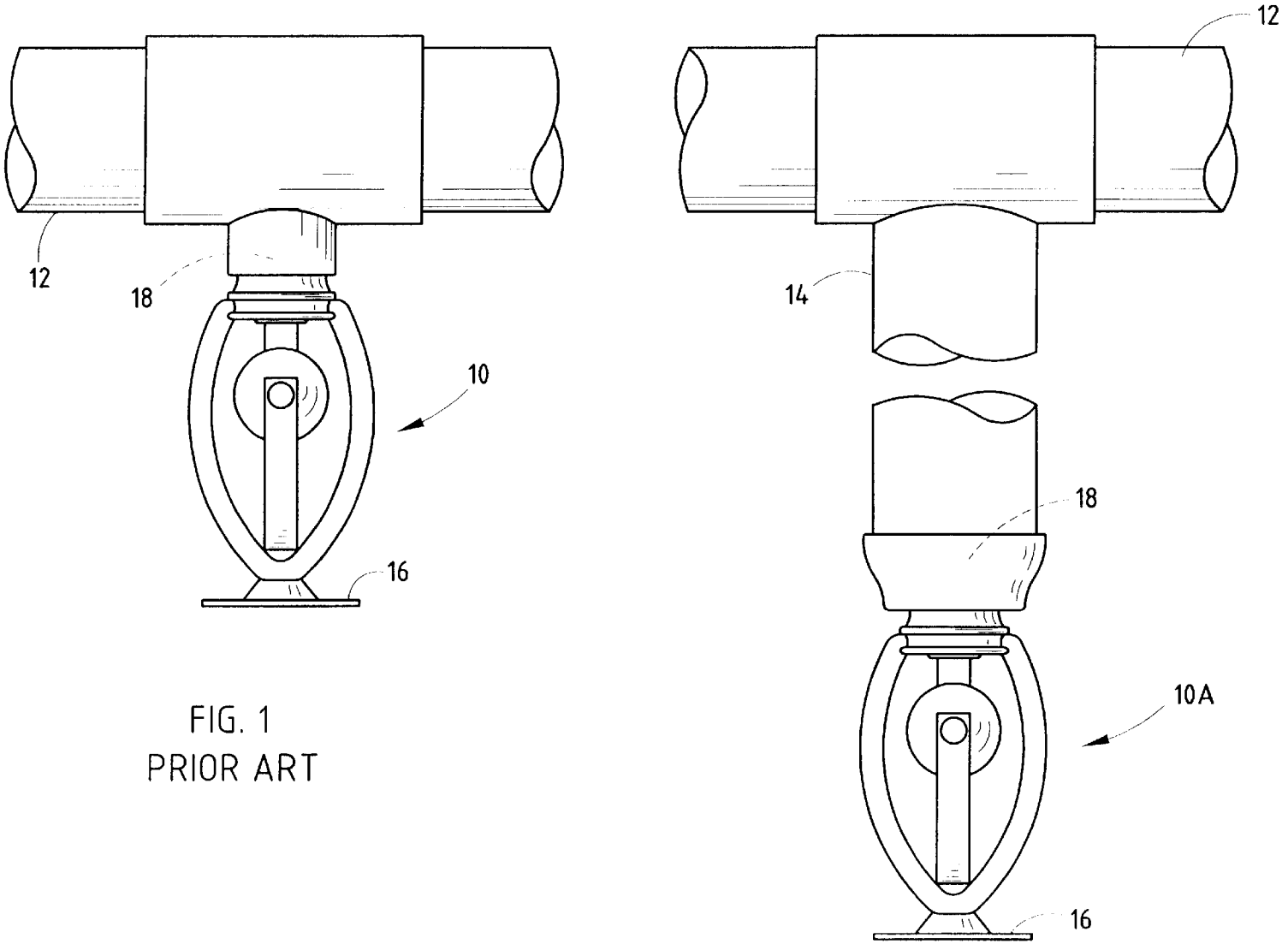
FIG. 1 PRIOR ART
FIG. 1 is a fragmentary, elevational view of a pair of prior art, pendant sprinkler heads illustrated attached to a water supply pipe.
Figure 2:
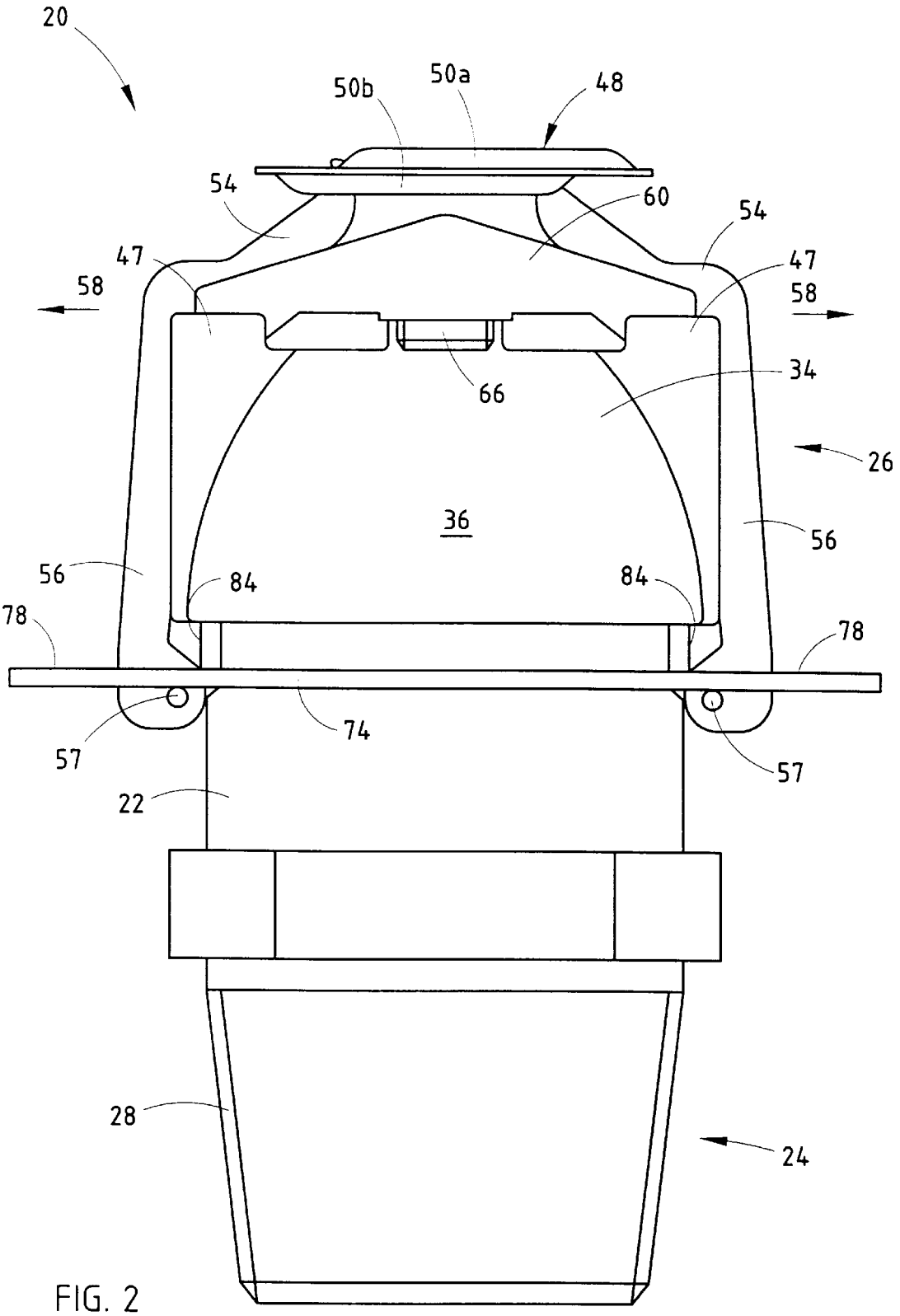
FIG. 2 is a front, elevational view of a sprinkler nozzle or head according to the present invention shown in an armed, non-activated condition.
Figure 5:
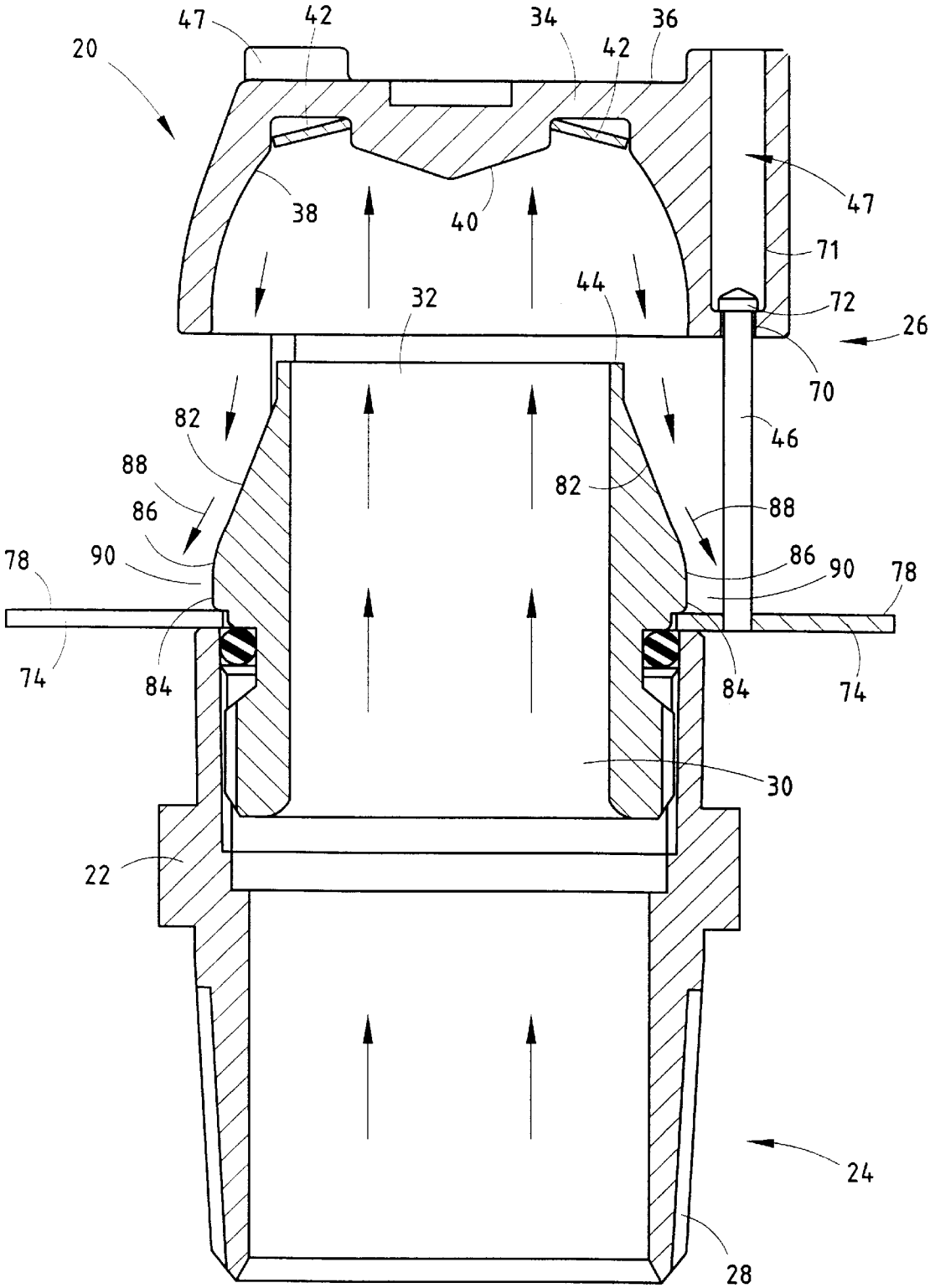
FIG. 5 is an elevational, sectional view taken along the same section as in FIG. 4, illustrating the sprinkler nozzle in an activated operating configuration.

The present invention will now be described with reference to the accompanying drawings wherein like reference numerals correspond to like elements in the several drawings. A sprinkler nozzle or head 20 according to one embodiment of the present invention is depicted in FIG. 2. Sprinkler head 20 includes a body 22 having a bottom end 24 and a top end 26. As shown in FIG. 5, sprinkler head 20 includes a deflector 74 located about body 22, and a fluid flow thrust reverser 34 positioned above deflector 74. When activated as shown in FIG. 5, fire extinguishing fluid flows through body 22, exits and impacts thrust reverser 34. The direction of flow of the fluid is reversed by thrust reverser 34 and directed back downwardly toward deflector 74, which is then impacted to distribute the fluid flow in the desired pattern.

Figure 4:
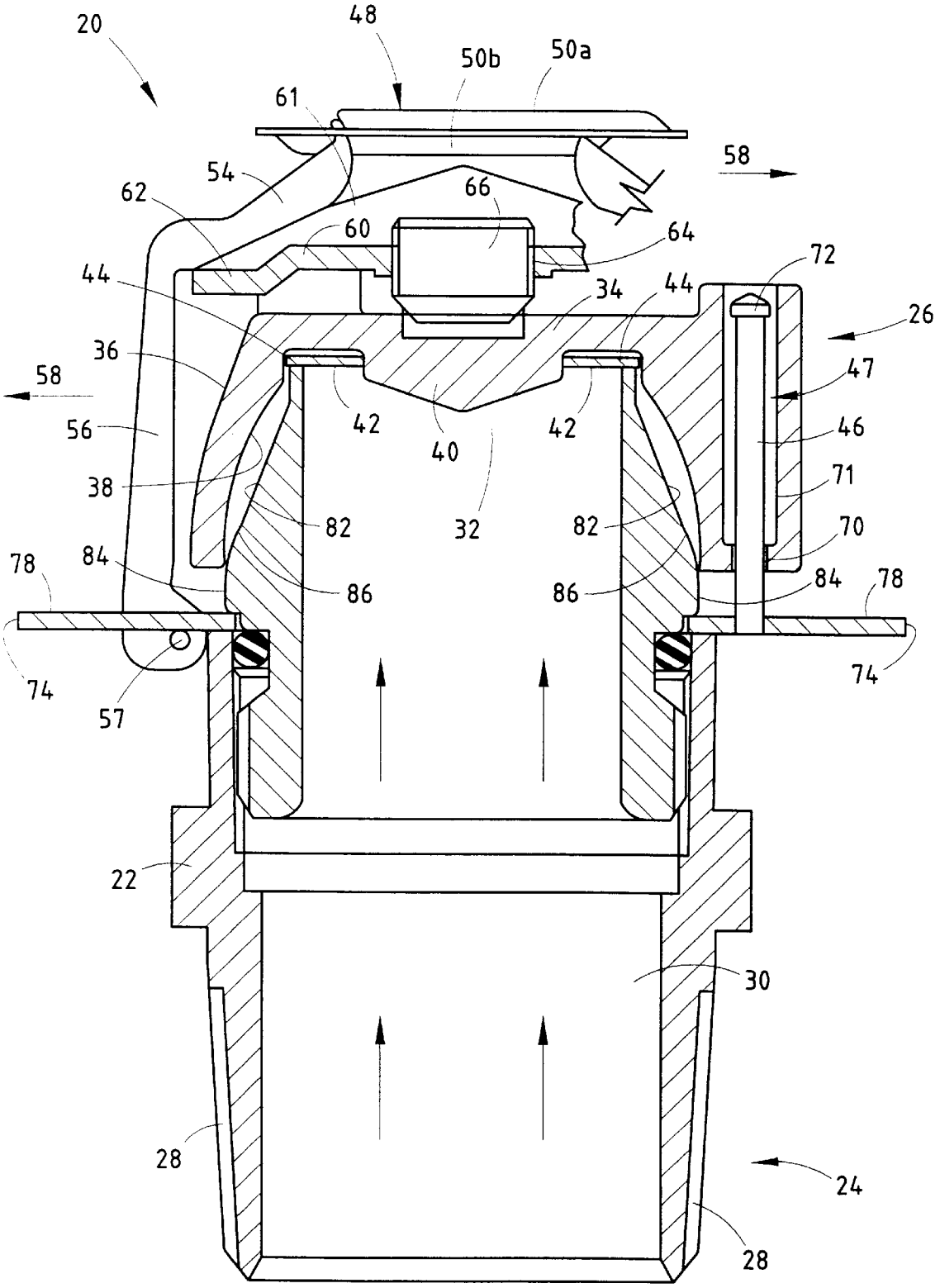
FIG. 4 is an elevational, sectional view taken along the lines IV—IV of FIG. 3.

Sprinkler nozzle 20 is an upright sprinkler and includes a plurality of external threads 28 adapted in a conventional fashion to mate with internal threads on the top side of a water supply pipe (not shown). Sprinkler nozzle 20 can, of course, be alternately configured with internal threads in order to mate with external threads on a water supply pipe. It will also be noted that, while the description of nozzle 20 is made with reference to using water to extinguish a fire, other fluids besides water can be used with the present invention. Body 22 of sprinkler head 20 defines a generally cylindrical, vertical channel 30 (FIG. 4). Channel 30 is filled with water or other fire extinguishing fluid and is in fluid communication with the supply pipe. A central outlet orifice 32 is defined adjacent top end 26 of body 22 (FIGS. 4 and 5).

When no fire has been detected, central outlet orifice 32 is sealed by a thrust reverser 34. Thrust reverser 34 includes an exterior surface 36 and an interior surface 38.

Interior surface 38 includes a central, cylindrical protrusion 40 that extends downwardly. An annular, doughnut shaped ring 42 is disposed around and attached to protrusion 40. Ring or seal 42 seals orifice 32 and prevents water from escaping when no fire is detected. Seal 42 is made from metal, such as a combination of beryllium and nickel, or any other combination as is known in the art. Metal seal 42 is covered by a Teflon tape, as is also known in the art. Seal 42 is held tightly against a top edge 44 of body 22 tightly enough to prevent water from escaping by an adjustment plate 60, described below.

Sprinkler head 20 is activated to begin sprinkling during a fire by a fusible link 48 located at top end 26 of sprinkler head 20. Fusible link 48 is made up of a pair of horizontally oriented plates 50*a* and 50*b* that are fused together by a temperature sensitive fusing material, such as a low temperature solder. Fusible link 48 is a conventional fusible link and can use any of a variety of known fusing materials. When the ambient temperature of fusible link 48 rises above a certain level, the fusing material melts and destroys the link between horizontal plates 50*a* and 50*b*. Horizontal plates 50*a* and 50*b* each include an aperture 52 (See FIG. 3) into which a top portion 54 of a pair of arms 56 are inserted. Arms 56 are tensioned outwardly in a direction 58 shown in FIGS. 3, 4, and 6. When the fusible material in fusible link 48 melts, arms 56 pull plates 50*a* and 50*b* apart. The separation of plates 50*a* and *b* activates the sprinkler nozzle as described below.

Disposed on the top of exterior surface 36 of thrust reverser 34 is an adjustment plate 60. Adjustment plate 60 includes a peripheral portion 62 that fits under top portion 54 of arms 56. Adjustment plate 60 further includes a pair of upturned sides 61 that provide increased structural strength for adjustment plate 60 (see FIGS. 3–6). Arms 56 secure adjustment plate 60 in position so long as fusible link 48 is not broken. When fusible link 48 is broken, arms 56 pivot outwardly about axes 57 and allow thrust reverser 34 and adjustment plate 60 to be pushed vertically upward by the force of the water. When thrust reverser 34 moves vertically upward, its motion is constrained by pins 46. Pins 46 are received in a set of pin chambers 47 defined in thrust reverser 34, and positioned therein loosely enough to allow thrust reverser 34 to slide upwardly on pins 34, and yet snugly enough to be guided vertically when thrust reverser 34 moves. Adjustment plate 60 includes a central, threaded aperture 64 into which an adjustment screw 66 is threadably inserted. The bottom of adjustment screws 66 contacts the top of thrust reverser 34 and thereby secures thrust reverser 34 over orifice 32 such that water does not escape from channel 30. By rotating adjustment screws 66 in central, threaded aperture 64, the tightness of thrust reverser 34 against orifice 32 can be adjusted as desired. Adjustment screws 66 is rotated by a screwdriver, or other suitable means, that fits through a central aperture 68 and fusible link 48. (See FIGS. 3 and 6). Adjustment plate 60 is not secured to any structure after sprinkler nozzle 20 has been activated, and therefore is free to fall off during a fire.

Figure 3:
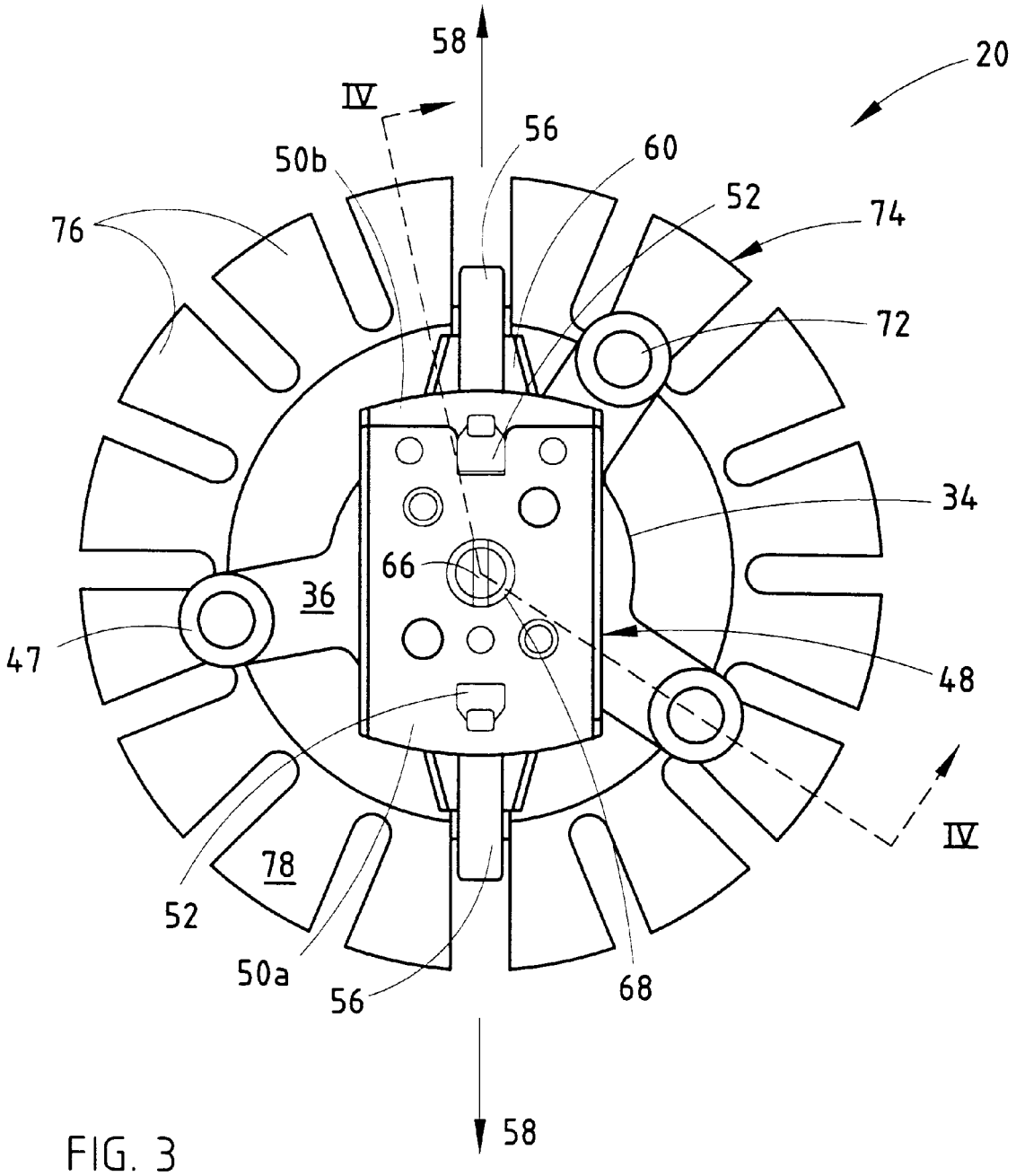
FIG. 3 is a plan view of the sprinkler nozzle of FIG. 2.
Figure 6:
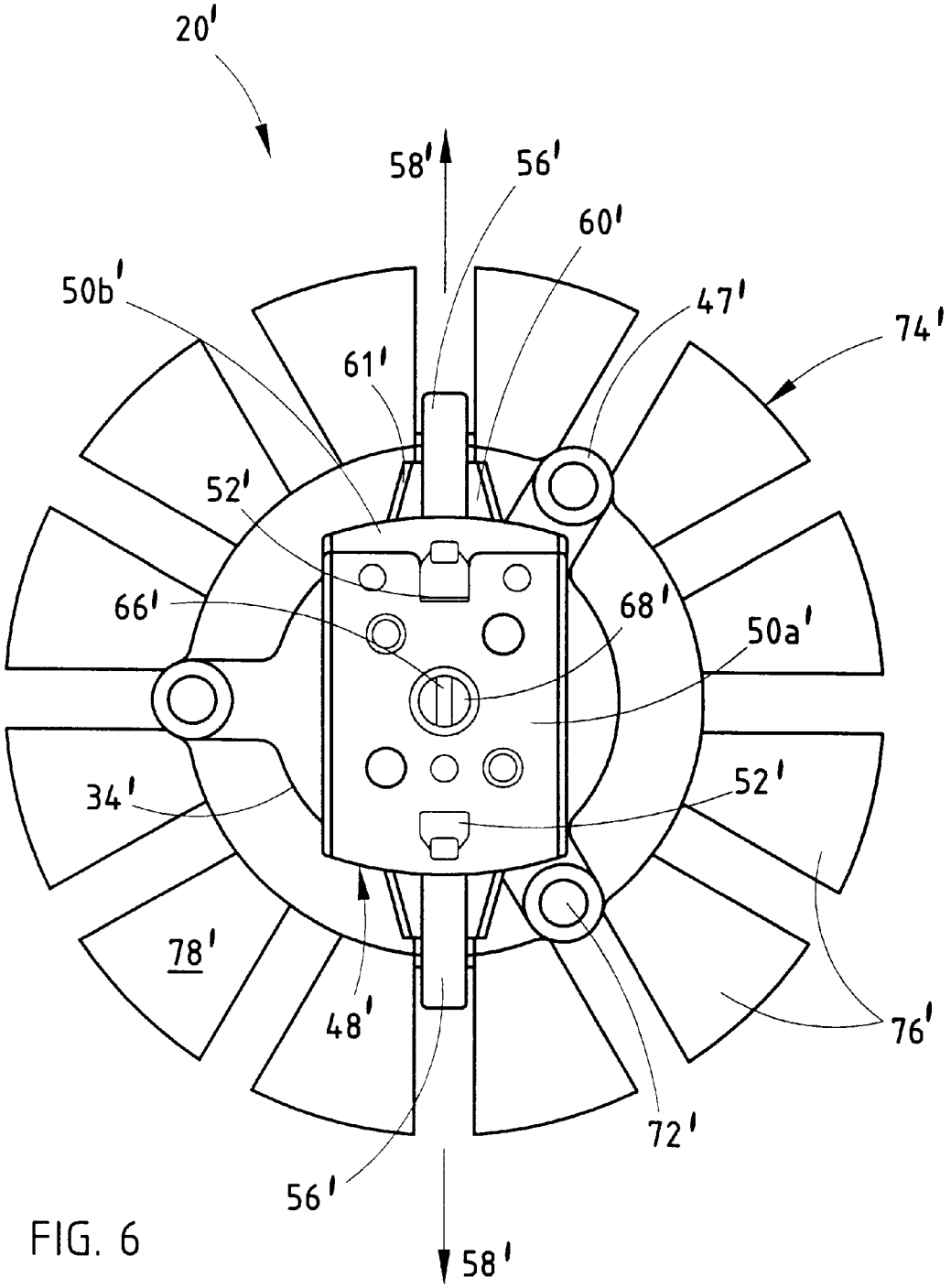
FIG. 6 is a plan view of an alternate embodiment of the sprinkler nozzle according to one aspect of the present invention.

As noted, thrust reverser 34, in one embodiment, includes a plurality of vertical pin chambers or bores 47. Chambers 47 include lower, narrow section 70 having a reduced diameter and an upper, wide section 71 of greater diameter. Pins 46 include a head 72 having a diameter greater than the diameter of narrow section 70 of chambers 47 yet smaller than the diameter of wide section 71. Pin heads 72 thereby prevent thrust reverser 34 from completely disconnecting itself from pins 46 when it moved upward by the flow of water. As can be seen, interior surface 38 of thrust reverser 34 is generally hemispherically shaped so as to provide a smoothly curved surface for directing fluid flow. Thrust reverser 34 reverses the flow of water exiting orifice 32 with a minimal decrease in the magnitude of the momentum of the flowing water. Most preferably thrust reverser reverses the water flow approaching about one hundred eighty degrees so that the water flow is back toward sprinkler body 22. The momentum of the water flow is thus reversed. An approximate representation of the fluid flow out of nozzle 20 is depicted by the arrows in FIG. 5. After the water, or other fluid, exits orifice 32 flowing in a vertical direction, it impinges interior surface 38 of thrust reverser 34. Interior surface 38 is shaped to reverse the flow of water so that it flows downwardly. As the water exits thrust reverser 34 in a downward direction, it impinges a top surface 78 of a deflector 74. Deflector 74 comprises a generally flat, annular plate having a plurality of prongs or extensions 76 (FIGS. 3 and 6). Because sprinkler head 20 is an upright sprinkler, top surface 78 of deflector 74 faces the ceiling in whatever room the sprinkler is located. Deflector 74 serves to dispense the water impinging its top surface about the area to be sprinkled.

Top end 26 of body 22 is shaped in a specific manner to ensure that nozzle 20 properly disperses water over the desired area. In particular, top end 26 of body 22 includes a sloping surface 82 that is generally frustoconically shaped. Sloping surface 82 slopes outwardly from top to bottom. A straight surface 84 is defined immediately below sloping surface 82. The junction 86 of straight surface 84 and sloping surface 82 gives rise to the Coanda effect when the sprinkler is activated and water is flowing. When the water impinges sloping surface 82, it is deflected generally in the direction depicted by arrows 88. The flow of water in the direction depicted by arrows 88 creates a low pressure area 90 due to the Coanda effect. Low pressure area 90 therefore diverts some of the flowing water downwardly along straight surface 84. The downwardly diverted flow of water along straight surface 84 impinges deflector 74 immediately adjacent body 22. The downwardly directed flow of water along straight surface 84 due to the Coanda effect ensures that the area immediately underneath sprinkler nozzle 20 is sprinkled with adequate water for fire extinguishing.

A top view of the second embodiment of a sprinkler head 20' according to the present invention is depicted in FIG. 6. Nozzle head 20' differs from nozzle 20 in that pins 46' are located between prongs or extensions 76' on deflector 74'. As can be seen in FIG. 3, pins 46 are located above prongs or extensions 76, rather than between them. It is believed that either arrangement provides acceptable sprinkling.

It will be understood by one skilled in the art that various modifications can be made to the sprinkler nozzle of the present invention without departing from the spirit of the invention. As one possible modification, thrust reverser 34 could alternately be fixedly attached to body 22, rather than vertically movable as in the depicted embodiment. Such a modification would require a sealing element disposed between thrust reverser 34 and orifice 32 that would collapse or otherwise be removed upon detection of a fire.

It will be understood that a variety of different dimensions can be used to practice the present invention. One example of dimensions that have been found acceptable in a sprinkler having a K value of $^{14GPM}/PSI^{1/2}$ is as follows. The diameter of the central outlet orifice 32 is 7/10", while the diameter of the lower end of thrust reverser 34 is nominal 1¼". When sprinkler head 20 is activated, thrust reverser 34 moves vertically upward approximately ¼" above central outlet orifice 32.

While the present invention has been described in terms of the preferred embodiments depicted in the drawings and discussed in the above specification, it will be understood by one skilled in the art that the present invention is not limited to these particular preferred embodiments, but includes any and all such modifications that are within the spirit and scope of the present invention as defined in the appended claims.

What is claimed is:

1. A method for controlling the flow of water through a fire-extinguishing nozzle and directing said water to an area to be protected, comprising:

providing a pressurized source of water;

providing a nozzle body defining an outlet and an internal channel in fluid communication with said pressurized source of water;

providing a sensor for detecting a fire;

pumping water from said pressurized water source through said internal channel and out said outlet during a fire, said water flowing out of said outlet in a first direction;

reversing the direction of flow of the water from said first direction to a second direction; and, after reversing said direction of water flow, dispersing said water about an area over which the fire is detected by impinging, said water against a deflector.

2. The method of claim 1 further comprising:

providing a sloped wall on said nozzle body;

providing a vertical wall on said nozzle body beneath said sloped wall; and, positioning said sloped and vertical walls in the path of the water flowing in a direction reversed from said first direction.

3. The method of claim 2 wherein said step of reversing the direction of flow of the water from said first direction is accomplished by a substantially hemispherical structure positioned over said outlet.

4. The method of claim 2 further including positioning said hemispherical structure tightly against said outlet when no fire is detected such that water does not flow out of said outlet, and moving said hemispherical structure to a second position spaced from said outlet when a fire is detected such that water flows out of said outlet.

5. A fire extinguishing sprinkler head for dispensing fire extinguishing fluid in the event of a fire, comprising:

a sprinkler body defining an outlet from which a fire extinguishing fluid flows in a fluid delivery area during a fire;

a deflector coupled to said sprinkler body, said deflector having a fluid impact surface and an opposite surface, said fluid impact surface configured to generate a preselected distribution of fluid over a zone to be protected;

a fluid flow thrust reverser disposed adjacent said outlet within said fluid delivery area and adapted to reverse the flow of fluid that flows out of said outlet and direct the fluid toward said deflector fluid impact surface; and a trigger element disposed above said thrust reverser and said deflector, said trigger element adapted to allow fluid to flow from said outlet when a fire temperature is detected by said trigger element.

6. The fire extinguishing sprinkler head of claim 5 wherein said trigger element comprises a fusible link and a pair of biased arms inserted into apertures defined in said fusible link, said biased arms attached to said sprinkler body.

7. The fire extinguishing sprinkler head of claim 6 further including at least two generally vertical pins attached to said deflector and inserted through a pair of apertures in said thrust reverser, said vertical pins adapted to allow said thrust reverser to move generally vertically between a closed position and an open position.

8. The fire extinguishing sprinkler head of claim 7 further including a tightening element disposed between said thrust reverser and said fusible link, said tightening element adapted to adjustably move said thrust reverser toward and away from said outlet.

9. A fire-protection sprinkling system for a building, comprising:

a pressurized water supply pipe positioned above an area to be protected by the fire-protection sprinkling system;

a deflector coupled to said supply pipe and having a top surface and a bottom surface, said top surface facing away from the area to be protected by the fire-protection system;

an upright sprinkler head disposed above said pressurized water supply pipe and in fluid communication with said supply pipe, said sprinkler head comprising a body defining a central channel through which a fire extinguishing fluid flows vertically upward when a fire is detected, said sprinkler head adapted to direct the flow of the fire extinguishing fluid onto said top surface of said deflector such that sufficient fire extinguishing fluid is delivered, with sufficient downward momentum, directly underneath the upright sprinkler head to generally extinguish a fire directly underneath the upright sprinkler head.

10. The fire-protection sprinkling system of claim 9 further including a trigger element disposed above said upright sprinkler head, said trigger element adapted to allow fire extinguishing fluid to flow through said channel during a fire and to prevent fire extinguishing fluid from flowing through said channel in the absence of a fire.

11. A fire-protection sprinkling system for a building, comprising:

a pressurized water supply pipe positioned above an area to be protected by the fire-protection sprinkling system;

a deflector coupled to said supply pipe and having a top surface and a bottom surface, said top surface facing away from the area to be protected by the fire-protection system;

an upright sprinkler head disposed above said pressurized water supply pipe and in fluid communication with said supply pipe, said sprinkler head comprising a body defining a central channel through which a fire extinguishing fluid flows vertically upward when a fire is detected, said sprinkler head adapted to direct the flow of the fire extinguishing fluid onto said top surface of said deflector; and said upright sprinkler head further comprising a vertical surface disposed above said deflector, and a sloped surface disposed above and adjacent to said vertical surface, said vertical and sloped surfaces adapted to direct the flow of the fire extinguishing fluid downward along said vertical surface by way of the coanda effect.

12. A sprinkler head, comprising:

a body defining a central bore having an upstream end and a downstream end;

an annular deflector disposed peripherally around said body, said annular deflector adapted to disperse fluid when the fluid impinges said annular deflector; and, a thrust reverser having an interior surface and an exterior surface, said thrust reverser disposed at said downstream end of said body oriented with said interior surface facing said downstream end of said body, said thrust reverser interior surface being generally curved and adapted to reverse the direction of fluid flowing out of said downstream end of said body prior to said fluid impinging said annular deflector.

13. The sprinkler head of claim 12 further including a seal disposed over said downstream end of said body and a trigger element for releasing said seal from said downstream end of said body when the ambient temperature of said sprinkler head rises above a fire detection level.

14. A sprinkler head, comprising:

a body defining a central bore having an upstream end and a downstream end;

an annular deflector disposed peripherally around said body, said annular deflector adapted to disperse fluid when the fluid impinges said annular deflector;

a thrust reverser having an interior surface and an exterior surface, said thrust reverser disposed at said downstream end of said body oriented with said interior surface facing said downstream end of said body, said thrust reverser configured and adapted to reverse the direction of fluid flowing out of said downstream end of said body prior to said fluid impinging said annular deflector; and a seal disposed over said downstream end of said body and a trigger element for releasing said seal from said downstream end of said body when the ambient temperature of said sprinkler head rises above a fire detection level; said seal being fixedly attached to said interior surface of said thrust reverser.

15. A sprinkler head, comprising:

a body defining a central bore having an upstream end and a downstream end;

an annular deflector disposed peripherally around said body, said annular deflector adapted to disperse fluid when the fluid impinges said annular deflector; and, a thrust reverser having an interior surface and an exterior surface, said thrust reverser disposed at said downstream end of said body oriented with said interior surface facing said downstream end of said body, said thrust reverser configured and adapted to reverse the direction of fluid flowing out of said downstream end of said body prior to said fluid impinging said annular deflector; wherein said body defines an angled surface an adjacent vertical, straight surface between said thrust reverser and said annular deflector, said angled surface creating a low pressure area due to the coanda effect along said vertical, straight surface when said fluid flows impinges and flows past said angled surface.

16. A sprinkler comprising:

a body having a first end and a second end, said body defining a central orifice adapted to allow a fluid to flow therethrough from said first end to said second end;

a thrust reverser disposed at said second end of said body;

a releasable seal disposed between said second end of said body and said thrust reverser;

a trigger element adapted to maintain said releasable seal tightly against said second end of said body when the ambient temperature is below a certain temperature, said trigger element adapted to release said seal from said second end of said body when the ambient temperature rises above said certain level; and, a flat, annular deflector disposed circumferentially around said body at a location between said first and said second ends of said body, said deflector defining a plurality of peripheral slots, said deflector positioned to deflect the fluid after the fluid flows through said orifice and has its direction reversed by said thrust reverser.

17. The sprinkler of claim 16 wherein said thrust reverser is fixedly mounted to said body.

18. The sprinkler of claim 16 wherein said thrust reverser is substantially hemispherically shaped.

19. The sprinkler of claim 16 wherein said trigger element is positioned between said seal and said thrust reverser.

20. A sprinkler comprising:

a body having a first end and a second end, said body defining a central orifice adapted to allow a fluid to flow therethrough from said first end to said second end;

a thrust reverser disposed at said second end of said body;

a releasable seal disposed between said second end of said body and said thrust reverser;

a trigger element adapted to maintain said releasable seal tightly against said second end of said body when the ambient temperature is below a certain temperature, said trigger element adapted to release said seal from said second end of said body when the ambient temperature rises above said certain level; and, a flat, annular deflector disposed circumferentially around said body at a location between said first and said second ends of said body, said deflector defining a plurality of peripheral slots, said deflector positioned to deflect the fluid after the fluid flows through said orifice and has its direction reversed by said thrust reverser;

wherein said thrust reverser is movably mounted to said body such that said thrust reverser is spaced away from said body when fluid is flowing through said orifice and is disposed adjacent said body when fluid is not flowing through said orifice.

21. The sprinkler of claim 20 wherein said releasable seal is fixedly mounted to said thrust reverser.

22. The sprinkler of claim 20 wherein said thrust reverser is movably mounted to said body by at least one guide pin attached at a first end to said deflector and slidably attached to said thrust reverser at a second end.

23. A fire extinguishing system for at least one room having a ceiling and a floor comprising:

a fluid supply pipe having a top facing the ceiling of said room and a bottom facing the floor of said room;

at least one upright sprinkler disposed on the top of said fluid supply pipe and in fluid communication with said fluid supply pipe;

a deflector mounted to said at least one upright sprinkler, said deflector having a top surface facing the ceiling of said room, said upright sprinkler adapted to direct fluid from said fluid supply pipe against said top surface of said deflector when a fire is detected such that sufficient fire extinguishing fluid is delivered, with sufficient downward momentum, directly underneath the upright sprinkler to generally extinguish a fire directly underneath the upright sprinkler head.

24. The fire extinguishing system of claim 23 wherein said fluid is water.

25. A fire extinguishing sprinkler head for dispensing fire extinguishing fluid in the event of a fire, comprising:

a sprinkler body defining an outlet from which a fire extinguishing fluid flows in a fluid delivery area during a fire;

a deflector coupled to said sprinkler body, said deflector having a fluid impact surface and an opposite surface, said fluid impact surface configured to generate a preselected distribution of fluid over a zone to be protected;

a fluid flow thrust reverser disposed adjacent said outlet within said fluid delivery area, said fluid flow thrust reverser having a generally curved interior surface that is impinged by said fluid when said fluid flows, said thrust reverser adapted to reverse the flow of fluid that flows out of said outlet and direct the fluid toward said deflector fluid impact surface.

26. A fire extinguishing sprinkler head for dispensing fire extinguishing fluid in the event of a fire, comprising:

a sprinkler body defining an outlet from which a fire extinguishing fluid flows in a fluid delivery area during a fire;

a deflector coupled to said sprinkler body, said deflector having a fluid impact surface and an opposite surface, said fluid impact surface configured to generate a preselected distribution of fluid over a zone to be protected;

a fluid flow thrust reverser disposed adjacent said outlet within said fluid delivery area and adapted to reverse the flow of fluid that flows out of said outlet and direct the fluid toward said deflector fluid impact surface;

at least two generally vertical pins coupled to said deflector and inserted through a pair of apertures in said thrust reverser, said vertical pins adapted to allow said thrust reverser to move generally vertically between a closed position and an open position.

27. The fire extinguishing sprinkler head of claim 26 wherein said thrust reverser includes an interior surface facing said sprinkler body and a seal fixedly mounted to said interior surface, said seal adapted to prevent fluid from flowing out of said outlet when said thrust reverser is in said closed position.

28. A fire extinguishing sprinkler head for dispensing fire extinguishing fluid in the event of a fire, comprising:

a sprinkler body defining an outlet from which a fire extinguishing fluid flows in a fluid delivery area during a fire;

a deflector coupled to said sprinkler body, said deflector having a fluid impact surface and an opposite surface, said fluid impact surface configured to generate a preselected distribution of fluid over a zone to be protected;

a fluid flow thrust reverser disposed adjacent said outlet within said fluid delivery area and adapted to reverse the flow of fluid that flows out of said outlet and direct the fluid toward said deflector fluid impact surface;

said sprinkler body including an outer sloped surface positioned between said deflector and said thrust reverser in a location impinged by fluid returning from said thrust reverser, and a straight, vertical surface positioned between said outer sloped surface and said deflector.

* * * * *